US012449192B2

(12) United States Patent
Lo

(10) Patent No.: US 12,449,192 B2
(45) Date of Patent: Oct. 21, 2025

(54) REFRIGERATOR DOOR WITH AN ADJUSTABLE MIRROR

(71) Applicant: RQ Innovasion Inc., Edmonton (CA)

(72) Inventor: Lenny Kwok Ming Lo, Edmonton (CA)

(73) Assignee: RQ Innovasion Inc., Edmonton (CA)

( * ) Notice: Subject to any disclaimer, the term of this patent is extended or adjusted under 35 U.S.C. 154(b) by 718 days.

(21) Appl. No.: 17/805,256

(22) Filed: Jun. 3, 2022

(65) Prior Publication Data

US 2023/0392855 A1 Dec. 7, 2023

(51) Int. Cl.

*F25D 23/12* (2006.01)
*A47B 67/00* (2006.01)
*F25D 23/02* (2006.01)

(52) U.S. Cl.

CPC ..... *F25D 23/12* (2013.01); *A47B 67/005* (2013.01); *F25D 23/028* (2013.01); *F25D 2323/024* (2013.01); *F25D 2327/001* (2013.01)

(58) Field of Classification Search

CPC ..... A47B 67/005; F25D 23/12; F25D 23/028; F25D 2323/024; F25D 2327/001; F25D 2400/40; F25D 2400/18; E05Y 2900/20; E05D 15/32; E05D 3/14; E05D 3/142; E05D 3/145; E05D 3/147; E05D 3/16; E05D 2003/163; E05D 2003/166; E05D 3/186; A45D 42/16; A45D 44/02; A45D 42/10; A45D 33/32

USPC ..... 16/370

See application file for complete search history.

(56) References Cited

U.S. PATENT DOCUMENTS

| | | | | | |
|---|---|---|---|---|---|
| 419,521 | A * | 1/1890 | Heald | F16M 11/38 | 248/277.1 |
| 3,732,702 | A * | 5/1973 | Desch | F25B 21/02 | 312/226 |
| 4,602,855 | A * | 7/1986 | Frey | A47G 1/24 | 248/476 |
| 5,164,861 | A * | 11/1992 | Katz | G02B 7/182 | 359/872 |
| 7,617,570 | B2 * | 11/2009 | Hill | D06F 39/14 | 16/370 |
| 2005/0132740 | A1 * | 6/2005 | Kwon | F25D 23/04 | 62/407 |
| 2005/0167563 | A1 * | 8/2005 | Delaney | A45D 20/12 | 248/475.1 |

(Continued)

FOREIGN PATENT DOCUMENTS

| | | | |
|---|---|---|---|
| CH | 621933 | A5 * | 3/1981 |
| CN | 211609010 | U * | 10/2020 |

OTHER PUBLICATIONS

CH621933 translation (Year: 1981).*
CN211609010 translation (Year: 2020).*

*Primary Examiner* — Hiwot E Tefera
(74) *Attorney, Agent, or Firm* — Patterson + Sheridan LLP

(57) ABSTRACT

A refrigerator includes a body, a door, a first arm, a mirror, and a second arm. The first arm is movably coupled to the door by a first hinge. The mirror is movably coupled to the first arm by a second hinge. The second arm is movably coupled to the door by a third hinge. The second arm is movably coupled to the first arm. The first arm is arranged to rotate about the first hinge to move the mirror away from the door. The mirror is arranged to rotate about the second hinge to tilt the mirror.

18 Claims, 11 Drawing Sheets

(56) References Cited

U.S. PATENT DOCUMENTS

| | | | | |
|---|---|---|---|---|
| 2006/0021360 | A1* | 2/2006 | Kim | F16M 11/08 62/126 |
| 2006/0118694 | A1* | 6/2006 | Lee | F16M 11/2064 40/711 |
| 2006/0125360 | A1* | 6/2006 | Kim | F16M 11/2014 312/405.1 |
| 2007/0126413 | A1* | 6/2007 | Oh | F16M 11/048 324/537 |
| 2007/0295020 | A1* | 12/2007 | Lee | F16M 11/14 62/331 |
| 2011/0023532 | A1* | 2/2011 | Kobayashi | F25D 23/025 62/524 |
| 2020/0268148 | A1* | 8/2020 | Kim | F25D 31/00 |

* cited by examiner

REFRIGERATOR DOOR WITH AN ADJUSTABLE MIRROR

TECHNICAL FIELD

Embodiments presented in this disclosure generally relate to refrigerator doors. More specifically, embodiments disclosed herein relate to a refrigerator door with an adjustable mirror.

BACKGROUND

Cosmetic refrigerators store cosmetic products in a cool environment, which extends the life of the cosmetic products. Due to their smaller size, cosmetic refrigerators may be placed on countertops or in vanity stations.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate typical embodiments and are therefore not to be considered limiting; other equally effective embodiments are contemplated.

To facilitate understanding, identical reference numerals have been used, where possible, to designate identical elements that are common to the figures. It is contemplated that elements disclosed in one embodiment may be beneficially used in other embodiments without specific recitation.

DESCRIPTION OF EXAMPLE EMBODIMENTS

Overview

Figure 1:
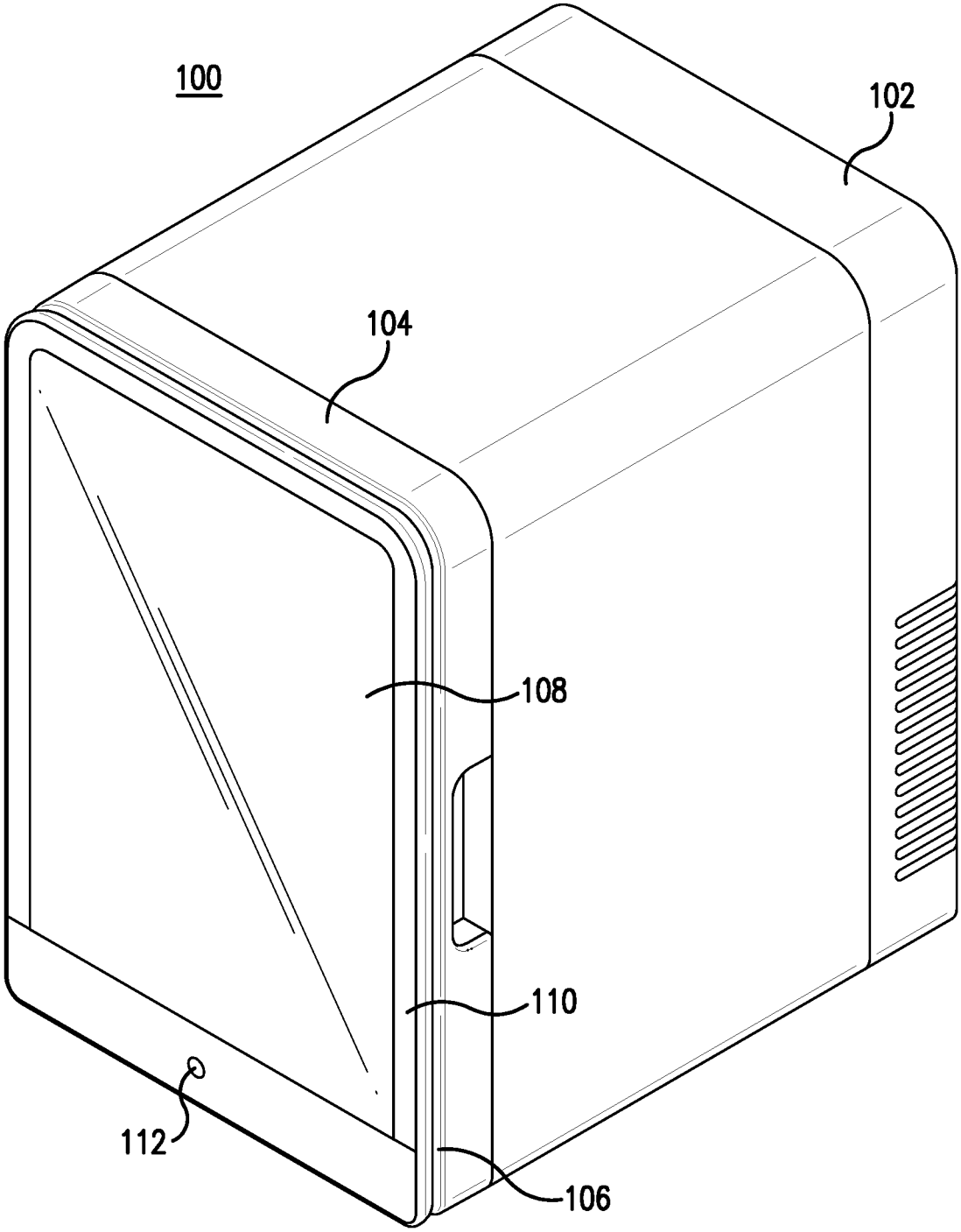
FIG. 1 illustrates an example refrigerator.

According to an embodiment, a refrigerator includes a body, a door movably coupled to the body, a first arm, a mirror, and a second arm. The door includes an inner surface and an outer surface opposite the inner surface. The inner surface faces the body when the door is closed. The outer surface defines a trough. The first arm includes a first end and a second end opposite the first end. The first arm is movably coupled to the door by a first hinge positioned proximate the first end and within the trough. The mirror is movably coupled to the first arm by a second hinge positioned proximate the second end. The second arm includes a third end and a fourth end opposite the third end. The second arm is movably coupled to the door by a third hinge positioned proximate the third end and within the trough. The second arm is movably coupled to the first arm at the fourth end. The first arm is arranged to rotate about the first hinge to move the mirror away from the door. The mirror is arranged to rotate about the second hinge to tilt the mirror.

According to another embodiment, a system includes a door, a first arm, a mirror, and a second arm. The door defines a trough. The first arm includes a first end and a second end opposite the first end. The first arm is movably coupled to the door by a first hinge positioned proximate the first end and within the trough. The mirror is movably coupled to the first arm by a second hinge positioned proximate the second end. The second arm includes a third end and a fourth end opposite the third end. The second arm is movably coupled to the door by a third hinge positioned proximate the third end and within the trough. The second arm is movably coupled to the first arm at the fourth end.

According to another embodiment, a system includes a door, first arm, a mirror, and a second arm. The first arm includes a first end and a second end opposite the first end. The first arm is movably coupled to the door by a first hinge positioned proximate the first end. The mirror is movably coupled to the first arm by a second hinge positioned proximate the second end. The second arm includes a third end and a fourth end opposite the third end. The second arm is movably coupled to the door by a third hinge positioned proximate the third end. The second arm is movably coupled to the first arm at the fourth end. The first arm is arranged to rotate about the first hinge to move the mirror away from the door. The mirror is arranged to rotate about the second hinge to tilt the mirror.

Example Embodiments

Some users prefer to retrieve cosmetic products from a cosmetic refrigerator and put on the cosmetic products without needing to first carry the cosmetic products to another location. Some cosmetic refrigerators may include mirrors that assist the user in putting on the cosmetic products without moving away from the cosmetic refrigerator. These mirrors, however, are typically fixed to the cosmetic refrigerator and due to the placement of the cosmetic refrigerator, the mirrors may not be angled to give the user an adequate view of the user's face. As a result, the user experiences difficulty putting on the cosmetic products.

The present disclosure describes a cosmetic refrigerator that is equipped with an adjustable mirror that may be moved to better assist the user put on cosmetic products. Generally, the mirror is attached to a door of the refrigerator by an arm and hinges. The arm and hinges provide two axes of rotation for the mirror, which allows the mirror to be moved and tilted to provide an adequate reflection of the user's face. A support arm may also be attached to the mirror and/or the arm to support the weight of the mirror. In some instances, the mirror may include lights (e.g., light emitting diodes) that emit light towards the user to illuminate the user's face. In this manner, the cosmetic refrigerator and mirror provide more assistance to the user when putting on cosmetic products relative to conventional cosmetic refrigerators, in some embodiments.

FIG. 1 illustrates an example of refrigerator 100. As seen in FIG. 1, the refrigerator 100 includes a body 102, a door 104, and a mirror 108. Generally, the mirror 108 is attached to the door 104 such that the mirror 108 is adjustable. For example, the mirror 108 may rotate about two hinges to elevate and tilt the mirror 108. As a result, the mirror 108 may be adjusted to better assist a user when the user is applying a cosmetic product.

The body 102 may house a cooling compartment and the cooling components of the refrigerator 100. Any suitable item, such as a cosmetic product, may be placed within the body 102. The body 102 may then cool that item using the cooling components. The cooling components may include any suitable components that keep the cooling compartment cool (e.g., a compressor and a heat exchanger). By cooling the items in the body 102, the refrigerator 100 may extend the life of the items within the refrigerator 100.

The door 104 is attached to the body 102. The door 104 may open and close to provide access to the cooling compartment within the body 102. For example, when the door 104 is open, the user may access the cooling compartment within the body 102. When the door 104 is closed, the door 104 may form a seal that protects against heat entering the cooling compartment through the door 104. The door 104 in FIG. 1 is closed. Additionally, as seen in FIG. 1, the door 104 includes an outer surface 106 that faces away from the body 102 when the door 104 is closed.

The mirror 108 is coupled to the outer surface 106 of the door 104. The mirror 108 includes a reflective surface that allows a user to see the user's face when the user is looking at the mirror 108. As discussed using subsequent figures, the mirror 108 is adjustable relative to the door 104. For example, the mirror 108 may rotate about two hinges to adjust the height and tilt of the mirror 108. In this manner, the mirror 108 may be adjusted to better assist the user when the user is applying a cosmetic product. For example, the mirror 108 may be adjusted to provide different perspectives or views of the user's face.

In some embodiments, the mirror 108 houses a metal plate (e.g., behind the reflective surface of the mirror 108). The metal plate may extend across any portion of the mirror 108. For example, the metal plate may extend across the backside of the reflective surface of the mirror 108, both in the horizontal and vertical directions. The metal plate allows magnets and other objects that include magnets to attach to the reflective surface of the mirror 108. For example, a curved mirror that provides magnification may include a magnet that magnetically attaches the curved mirror to the reflective surface of the mirror 108. In this manner, the curved mirror provides a magnified view of a portion of the user's face when the user is looking at the mirror 108. As another example, decorative magnets, magnetic photographs, magnetic selfie holders, magnetic clips, or other magnetic accessories may magnetically attach to the reflective surface of the mirror 108.

A light 110 may be disposed on or within the mirror 108. As seen in FIG. 1, the light 110 is positioned around a periphery of the mirror 108. The light 110 may include light-emitting diodes that may be turned on or off to direct light towards a user's face. In this manner, the light 110 may be turned on to illuminate the user's face, which may improve the user's view when looking at the user's face in the mirror 108.

In some embodiments, the refrigerator 100 includes a button 112. The button 112 may be positioned in any suitable location on the refrigerator 100. In the example of FIG. 1, the button 112 is positioned near the bottom of the mirror 108. A user may press the button 112 to turn on or turn off the light 110. Thus, the button 112 provides control over when the light 110 turns on or turns off.

Figure 2:
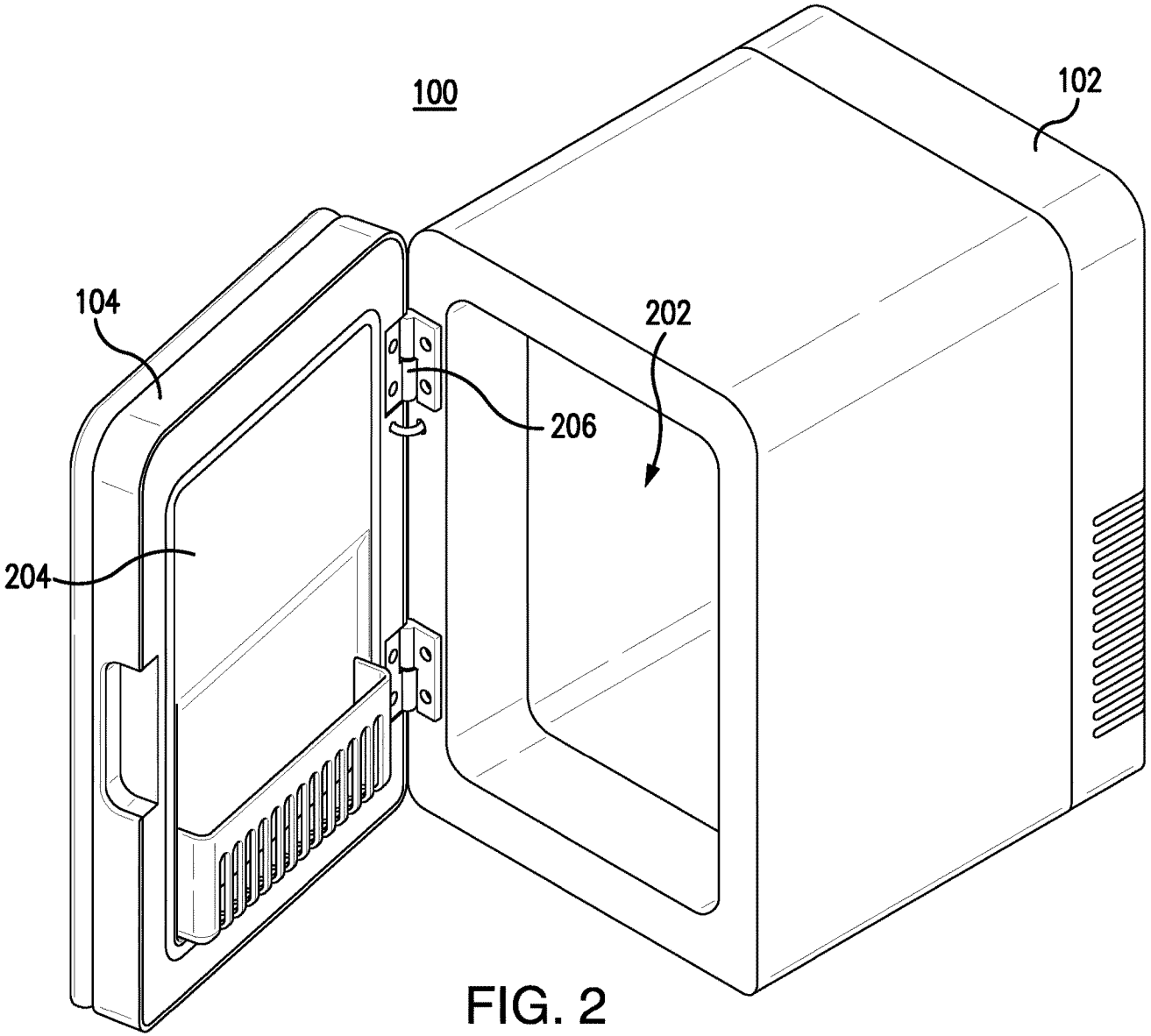
FIG. 2 illustrates an example interior of the refrigerator of FIG. 1.

FIG. 2 illustrates an example interior of the refrigerator 100 of FIG. 1. As seen in FIG. 2, the door 104 of the refrigerator 100 is open. When the door 104 is open, a user may access a cooling compartment 202 in the body 102. Various items, such as cosmetic products, may be stored within the cooling compartment 202 to cool those items, which extends the life of those items.

The door 104 includes an inner surface 204 that is opposite the outer surface of the door 104. The inner surface 204 faces the body 102 of the refrigerator 100 when the door 104 is closed. The inner surface 204 may form a seal with the body 102 to protect against heat entering the cooling compartment 202 when the door 104 is closed.

The door 104 may be attached to the body 102 by one or more hinges 206. As seen in FIG. 2, the hinges 206 attach to one end of the door 104 and to an end of the body 102. The hinges 206 allow the door 104 to rotate about the hinges 206 to open and close the door 104. In some embodiments, the movement or adjustment direction of the mirror is orthogonal to the direction of rotation of the door 104 about the hinges 206.

Figure 3:
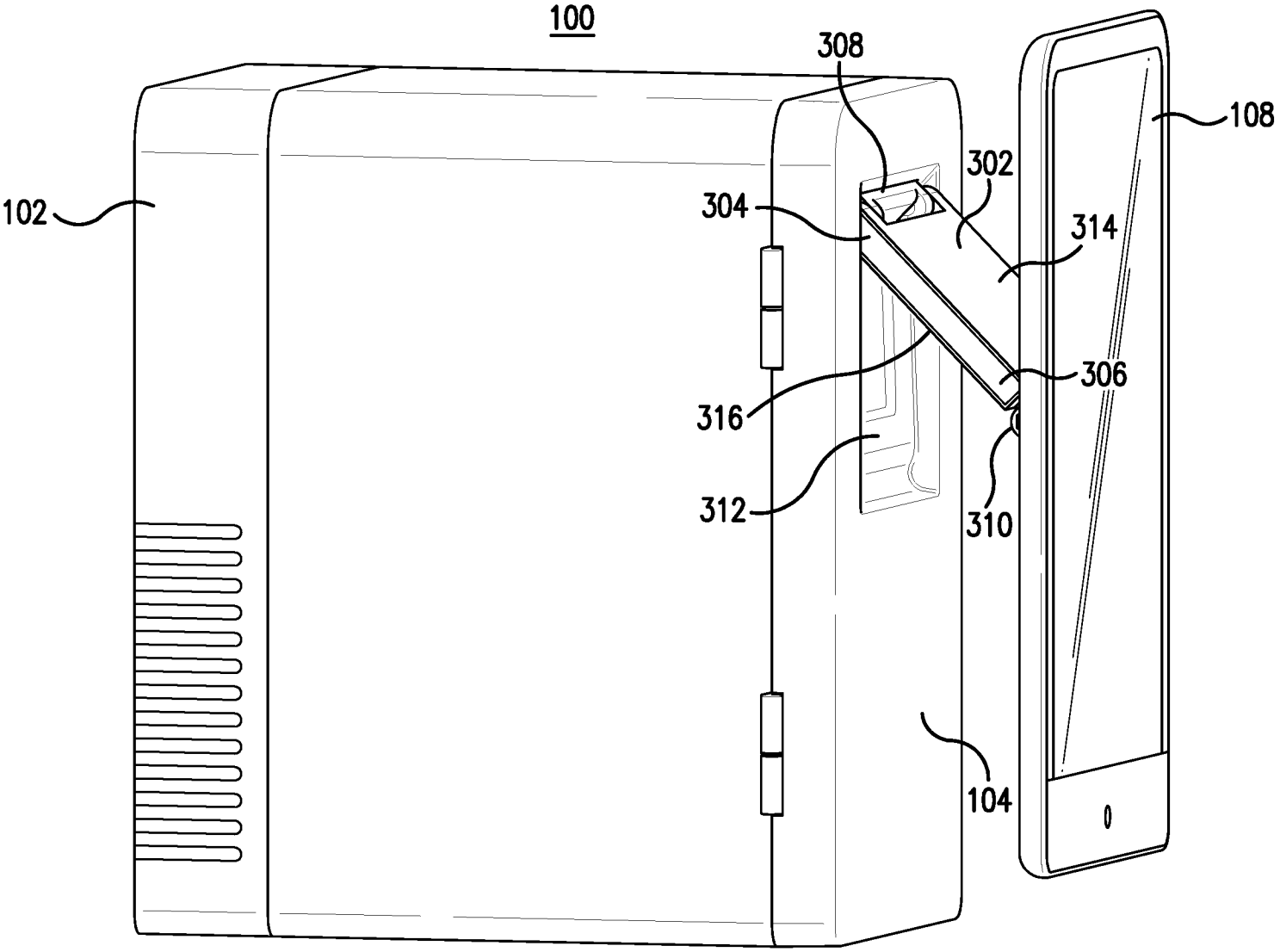
FIG. 3 illustrates an example side view of the refrigerator of FIG. 1.

FIG. 3 illustrates an example side view of the refrigerator 100 of FIG. 1. As seen in FIG. 3, the mirror 108 may be adjusted so that the mirror 108 moves out and away from the door 104 of the refrigerator 100. An arm 302 attaches the mirror 108 to the door 104. The arm 302 includes an end 304 and an end 306. The end 304 is opposite the end 306. The end 304 of the arm 302 is attaches to the door 104 of the refrigerator 100. The end 306 of the arm 302 attaches to the mirror 108.

The end 304 of the arm 302 attaches to the door 104 by a hinge 308. For example, the end 304 of the arm 302 may attach or couple to the hinge 308 and to the door 104. The arm 302 may rotate about the hinge 308 to move the mirror 108 out and up from the door 104. The end 306 of the arm 302 attaches or couples to the mirror 108 using a hinge 310. The mirror 108 may rotate about the hinge 310 to tilt the mirror 108. As a result, the hinges 308 and 310 allow adjustment of the mirror 108 such that the mirror 108 provides different perspectives or views of a user's face when the user is looking into the mirror 108. As discussed previously, the movement of the arm 302 about the hinge 308 and the movement of the mirror 108 about the hinge 310 may be orthogonal to the movement of the door 104 of the refrigerator 100 about the hinges 206 (shown in FIG. 2) to open and close the door 104.

The door 104 defines a trough 312 into which the arm 302 rests when the mirror 108 is rotated about the hinge 308 back towards the door 104. The arm 302 includes an outer surface 314 and an inner surface 316. The inner surface 316 is opposite the outer surface 314. When the arm 302 rotates about the hinge 308 to bring the mirror 108 closer to the door 104, the inner surface 316 faces the trough 312 and the outer surface 314 faces the mirror 108. When the arm 302 is rotated about the hinge 308 to bring the mirror 108 back towards the door 104, the arm 302 moves towards the trough 312, and eventually enters the trough 312. The space provided by the trough 312 for the arm 302 allows the mirror 108 to be brought closer to the door 104.

Figure 4:
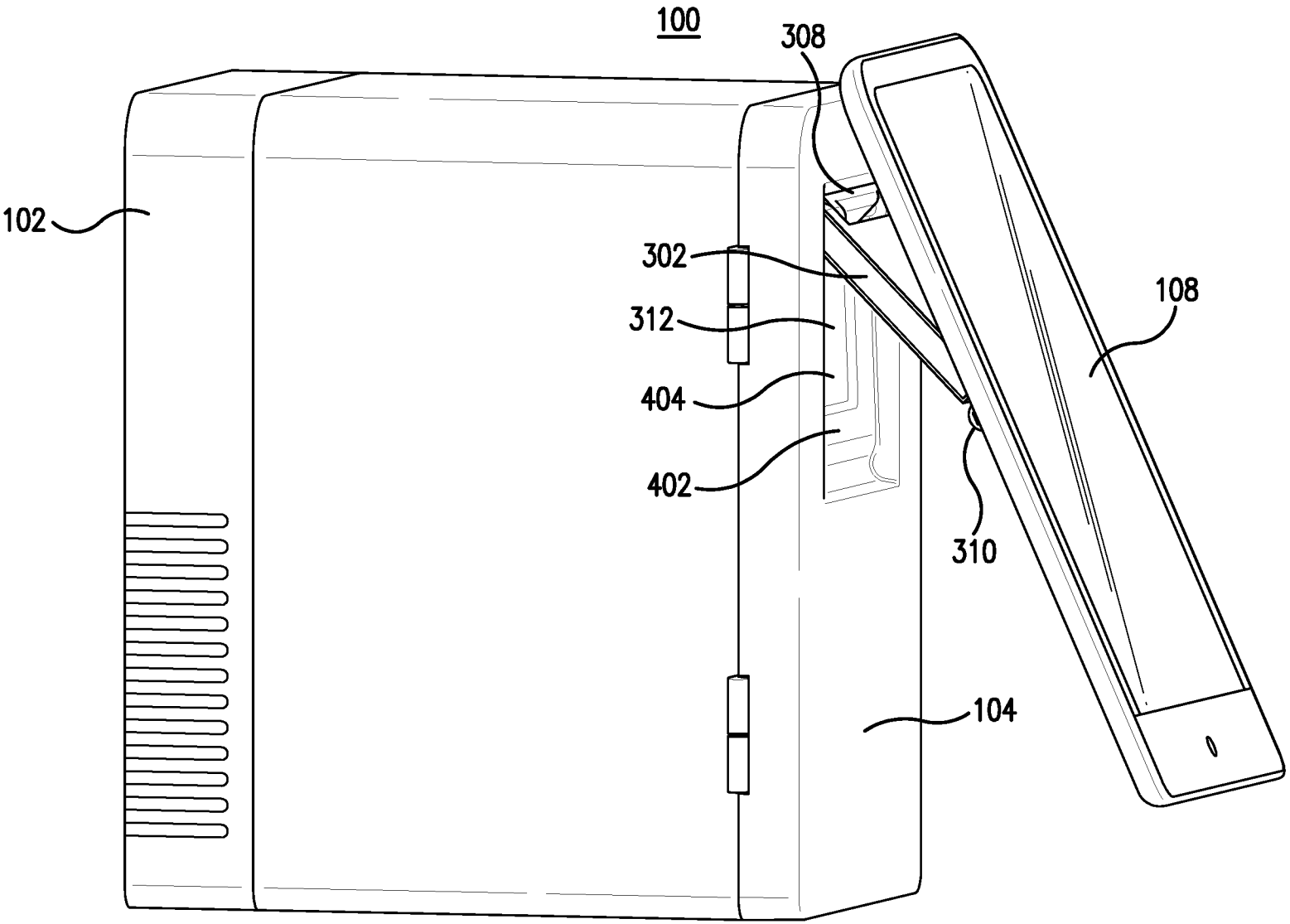
FIG. 4 illustrates an example isometric view of the refrigerator of FIG. 1.

FIG. 4 illustrates an example isometric view of the refrigerator 100 of FIG. 1. As seen in FIG. 4, the mirror 108 is rotated out and up from the door 104. Additionally, the mirror 108 has been titled upwards. As discussed previously, the arm 302 has been rotated about the hinge 308 to move the mirror 108 out and up from the door 104. Additionally, the mirror 108 has been rotated about the hinge 310 to tilt the mirror 108.

When the arm 302 rotates about the hinge 308 to move the mirror 108 out and up from the door 104, the arm 302 is moved out from the trough 312. As seen in FIG. 4, the trough 312 includes a portion 402 and a portion 404. Generally, the portion 404 is deeper than the portion 402. As a result, different portions of the trough 312 may have different depths to accommodate different contours or different objects. The portion 402 of the trough 312 may be deep enough to fit the arm 302 when the arm 302 is rotated about the hinge 308 back towards the door 104.

In some embodiments, the door 104 is an insulated door that protects against heat entering the cooling compartment within the body 102 of the refrigerator 100. The door 104 may house insulation that prevents heat flow through the door 104. The door 104 may include a first type of insulation within the door 104, and the door 104 may include a second type of insulation in the region of the trough 312. Because the thickness of the door 104 is reduced around the region of the trough 312, a thinner layer of a stronger insulation is used in the region of the trough 312 to protect against heat flow through the trough 312. As a result, the door 104 includes a first type of insulation within the door 104, and a second type of insulation within the door 104 around the region of the trough 312.

Figure 5:
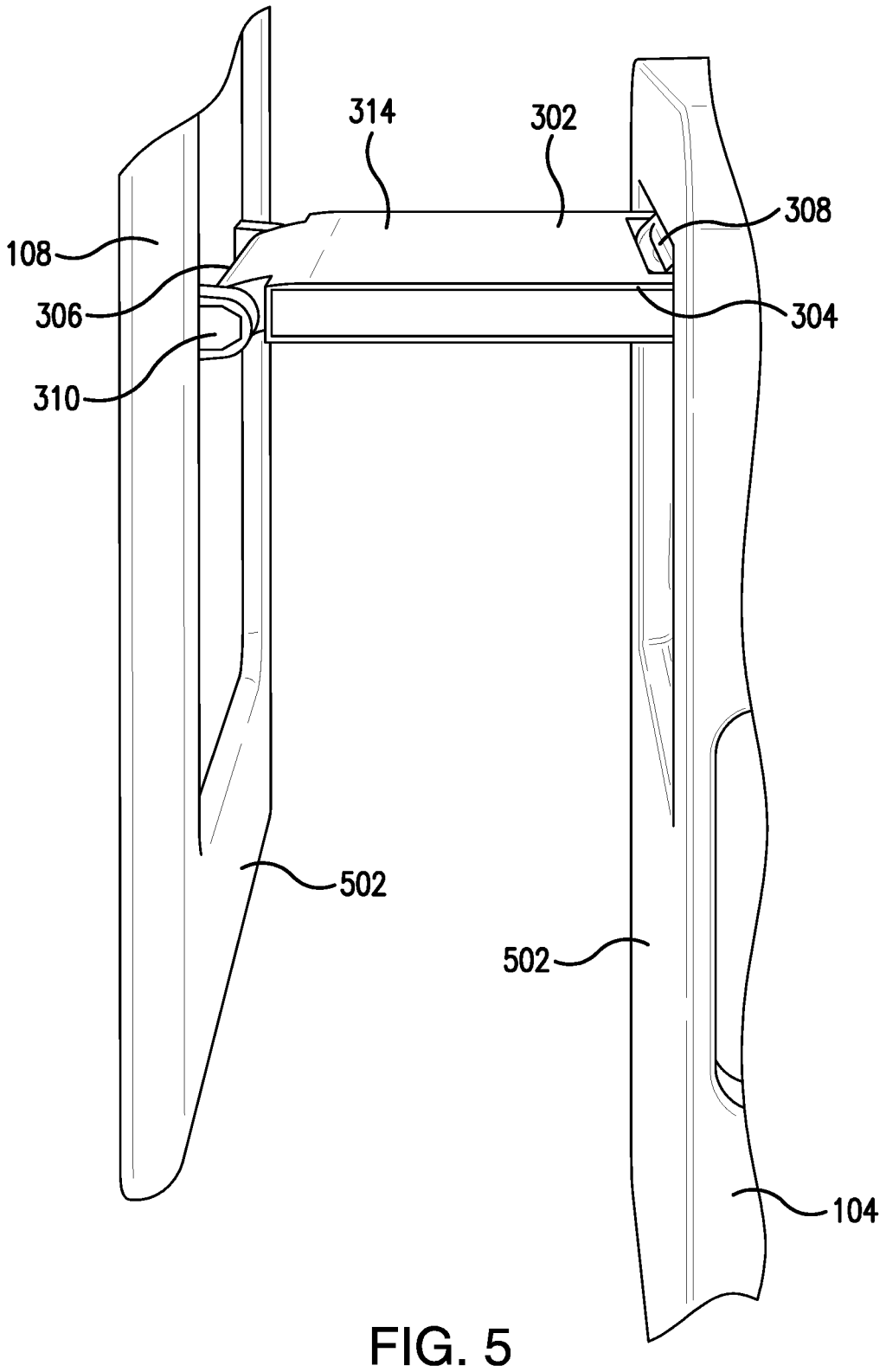
FIG. 5 illustrates a portion of the refrigerator of FIG. 1.

FIG. 5 illustrates a portion of the refrigerator 100 of FIG. 1. As seen in FIG. 5, the arm 302 is rotated about the hinge 308 to move the mirror 108 up and out from the door 104. The end 304 of the arm 302 attaches to the door 104 using the hinge 308. The end 306 of the arm 302 attaches to the mirror 108 using the hinge 310. The mirror 108 may rotate about the hinge 310 to tilt the mirror 108.

In certain embodiments, the mirror 108 or the door 104 may house one or more magnets 502 that pull the mirror 108 towards the door 104 when the mirror 108 is brought near the door 104. The magnets 502 may exert a magnetic force that pulls the mirror 108 towards the door 104. In this manner, the magnets 502 protect against the mirror 108 from being unintentionally moved out and away from the door 104. The magnets 502 may be housed within the mirror 108 or the door 104 and may not be visible from the outside of the refrigerator 100. As discussed previously, the mirror 108 may also house a metal plate (not shown) positioned behind the reflective surface of the mirror 108. The metal plate allows for other objects to magnetically attach to the reflective surface of the mirror 108.

Figure 6:
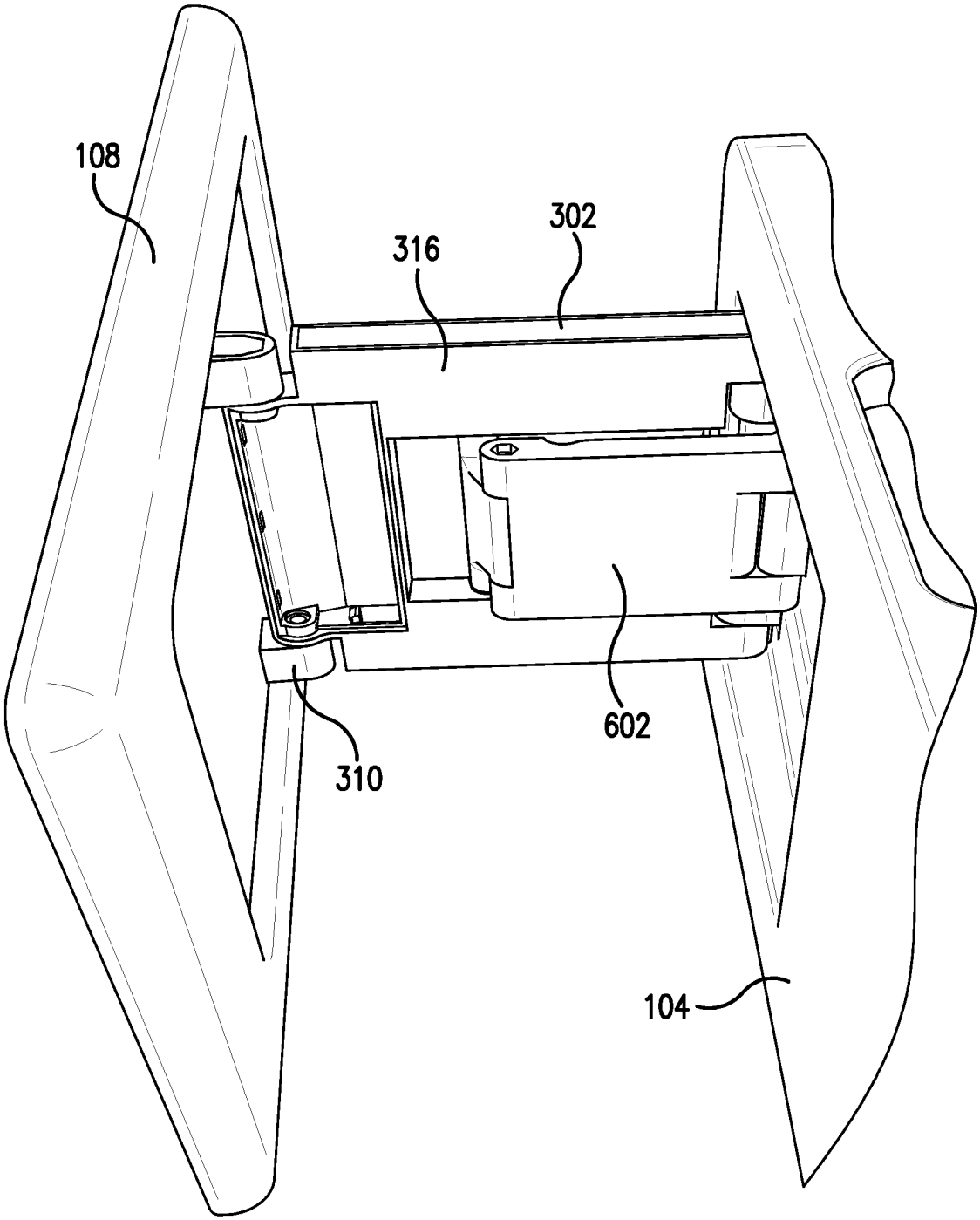
FIG. 6 illustrates a portion of the refrigerator of FIG. 1.

FIG. 6 illustrates a portion of the refrigerator 100 of FIG. 1. As seen in FIG. 6, the arm 302 is rotated so that the mirror 108 is moved up and out from the door 104. The refrigerator 100 includes an arm 602 that is positioned along the inner surface 316 of the arm 302. Generally, the arm 602 may be a secondary arm that provides mechanical support to the arm 302. The arm 602 supports the arm 302 so that the weight of the mirror 108 does not cause the arm 302 to rotate back towards the door 104. In this manner, the arm 602 supports the weight of the mirror 108 and allows the arm 302 to maintain position when the mirror 108 is moved up and out from the door 104.

Figure 7:
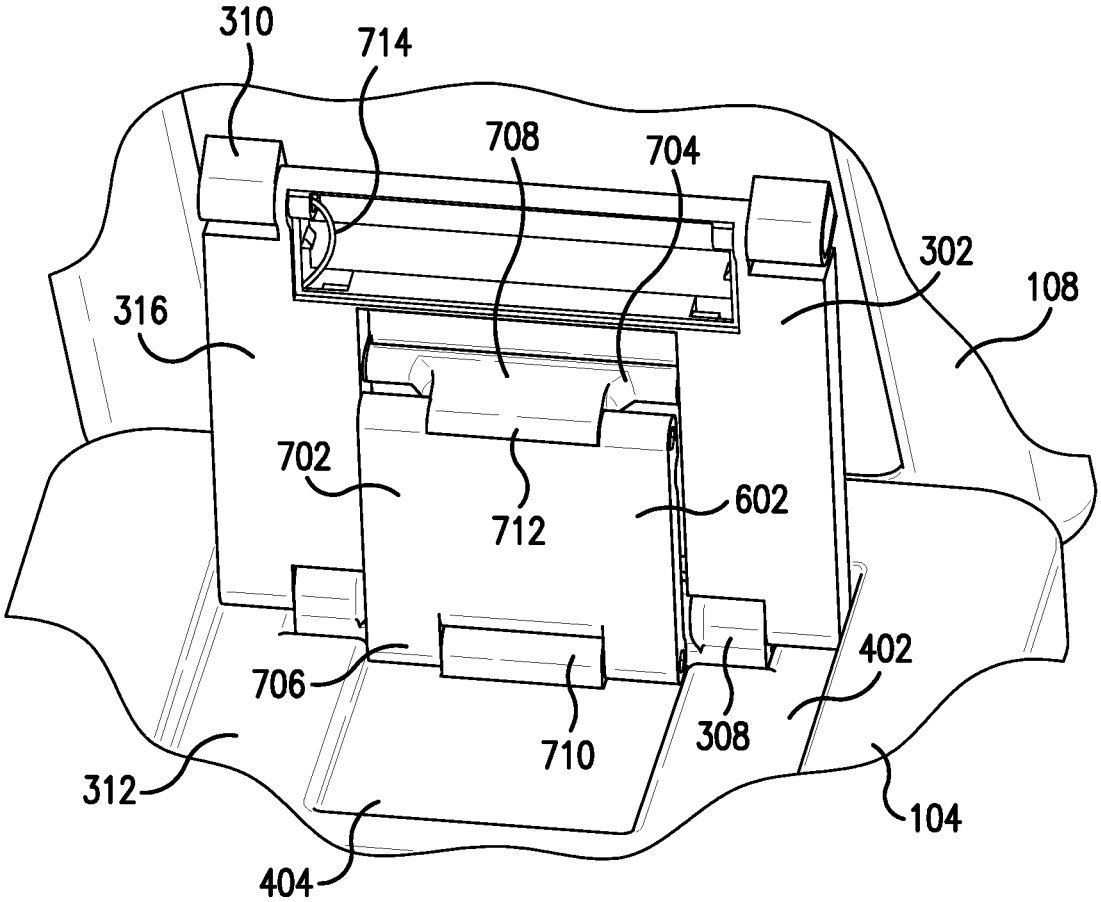
FIG. 7 illustrates a portion of the refrigerator of FIG. 1.

FIG. 7 illustrates a portion of the refrigerator 100 of FIG. 1. As seen in FIG. 7, the arm 602 includes an arm body 702 and an extension 704. Both the arm body 702 and the extension 704 are positioned along the inner surface 316 of the arm 302. The arm 602 includes an end 706 and an end 708 that is opposite the end 706. The extension 704 is positioned at the end 708. The end 706 is an opposite end of the arm body 702.

The arm body 702 is attached to the door 104 at the end 706 by a hinge 710. The hinge 710 may be positioned within the portion 404 of the trough 312. Because the portion 404 is deeper than the portion 402, the portion 404 may accommodate the arm 602 when the arm 602 rotates about the hinge 710 towards the door 104. Additionally, as seen in FIG. 7, the hinge 308 is positioned within the portion 402 of the trough 312. The arm 302 may rotate about the hinge 308 towards the door 104 such that the arm 302 rests within the portion 402 of the trough 312.

The extension 704 may be coupled to the arm body 702 by a hinge 712. The extension 704 may rotate about the hinge 712. The extension 704 may also couple to the arm 302 (e.g., by another hinge). As the arm body 702 rotates about the hinge 710, the extension may rotate about the hinge 712 and push away from the arm 302 but maintain contact with the arm 302, which may cause the arm 602 to separate slightly from the arm 302. In this manner, the extension 704 and the arm body 702 help the arm 302 support the weight of the mirror 108.

Additionally, as seen in FIG. 7, a wire 714 extends through the arm 302 to the mirror 108. The wire 714 may supply electric energy to a light disposed on or in the mirror 108. The wire 714 may extend from the mirror 108 through the arm 302 and the door 104 to electrical components within the refrigerator 100.

Figure 8:
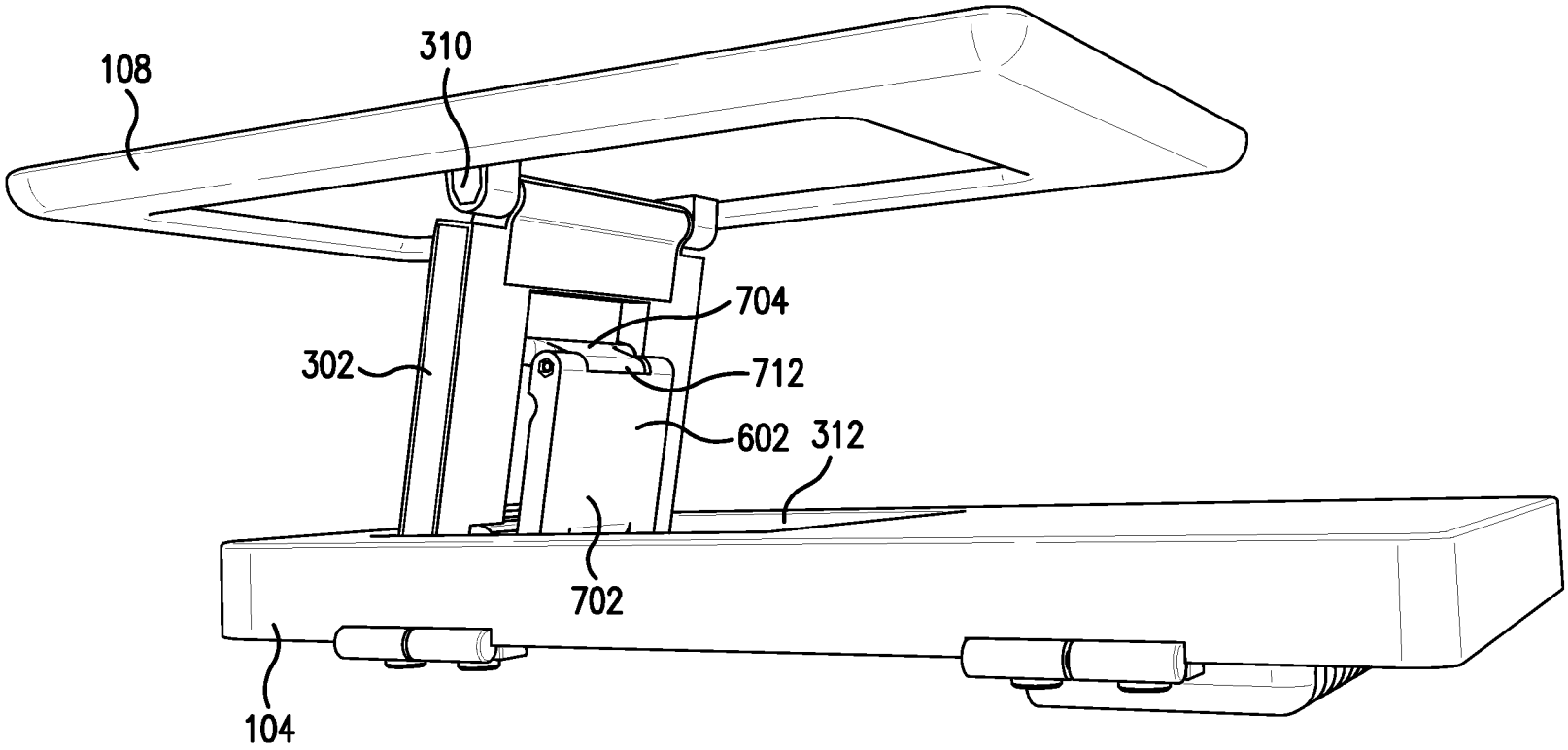
FIG. 8 illustrates a portion of the refrigerator of FIG. 1.

FIG. 8 illustrates a portion of the refrigerator 100 of FIG. 1. As seen in FIG. 8, the arm 602 includes the arm body 702 and the extension 704. The arm body 702 is attached to the door 104 within the trough 312. The extension 704 is attached to the arm body 702 by the hinge 712. The extension 704 may rotate about the hinge 712, which may cause the arm body 702 to move relative to the arm 302. Additionally, the mirror 108 is attached to the arm 302 using the hinge 310. The mirror 108 may rotate about the hinge 310 to tilt the mirror 108.

Figure 9:
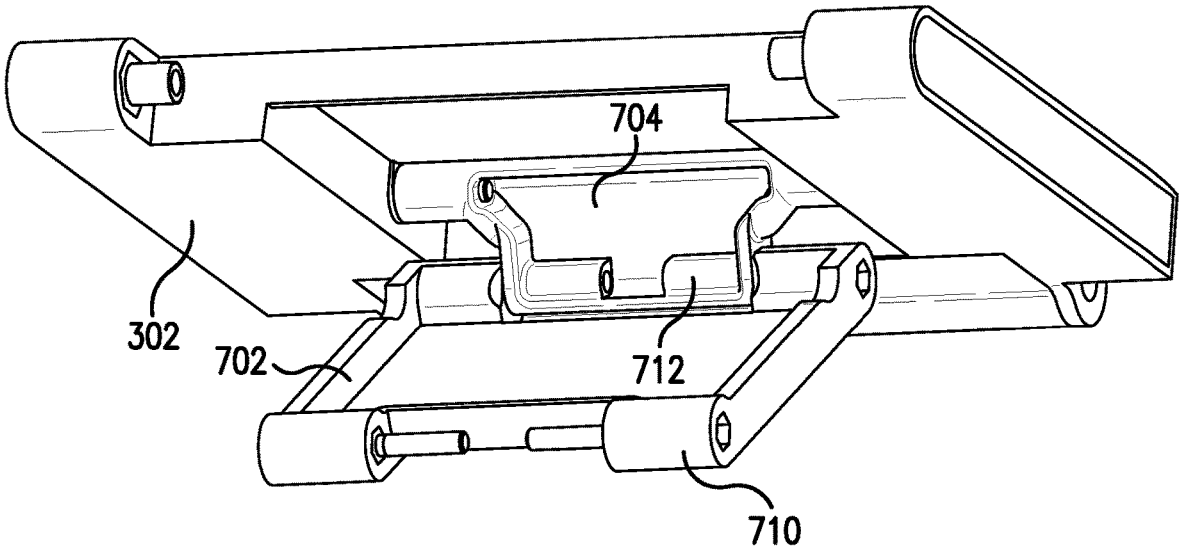
FIG. 9 illustrates a portion of the refrigerator of FIG. 1.

FIG. 9 illustrates a portion of the refrigerator 100 of FIG. 1. As seen in FIG. 9, the arm body 702 is attached to the arm 302 and to the extension 704 using the hinge 712. The extension 704 may rotate about the hinge 712. The arm body 702 includes the hinge 710 at an opposite end of the arm body 702 from the hinge 712. As discussed previously, the arm body 702 may attach to the door 104 by the hinge 710.

Figure 10:
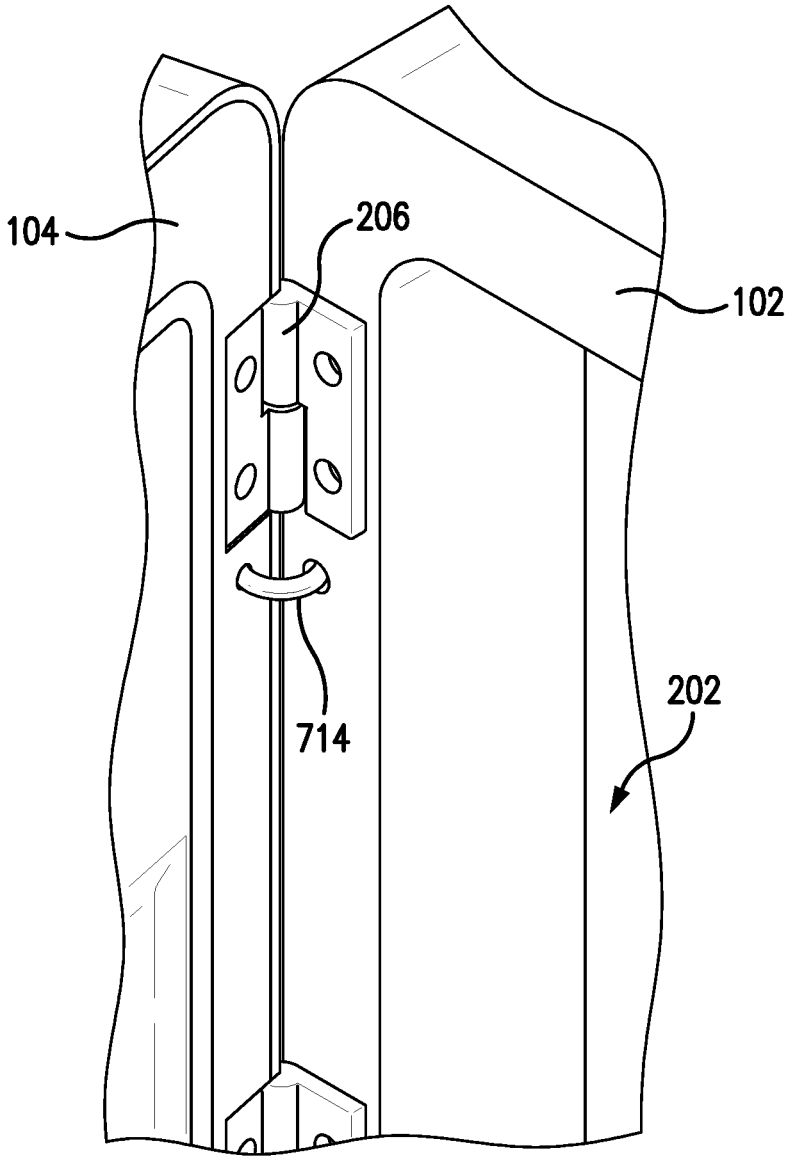
FIG. 10 illustrates a portion of the refrigerator of FIG. 1.

FIG. 10 illustrates a portion of the refrigerator 100 of FIG. 1. As seen in FIG. 10, the door 104 of the refrigerator 100 attaches to the body 102 of the refrigerator 100 using a hinge 206. The door 104 may rotate about the hinge 206 to open and close the door 104. When the door 104 is opened, there is access to a cooling compartment 202 within the body 102. When the door 104 is closed, the door 104 protects against heat flow through the door 104 into the cooling compartment 202. Additionally, the wire 714 may extend through the door 104 and the body 102 near the hinge 206. As discussed previously, the wire 714 supplies electrical energy to a light disposed on or in the mirror attached to the door 104. The wire 714 extends through the body 102 to electrical components within the body 102. These electrical components supply electric energy through the wire 714 to the light on or in the mirror.

Figure 11:
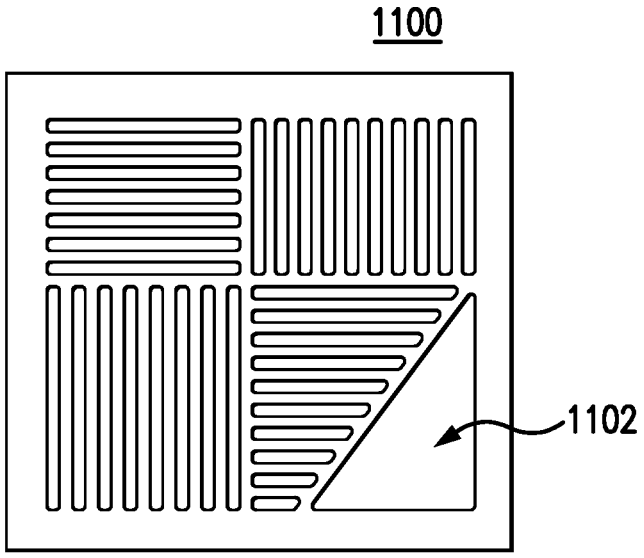
FIG. 11 illustrates an example shelf of the refrigerator of FIG. 1.
Figure 12:
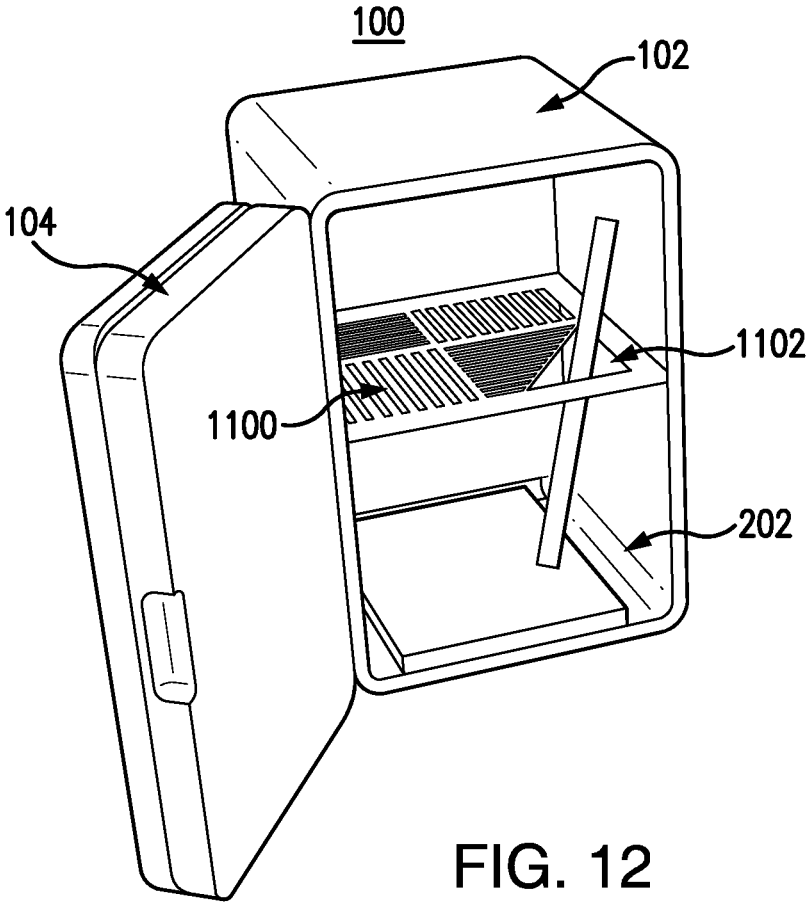
FIG. 12 illustrates an example interior of the refrigerator of FIG. 1.

FIG. 11 illustrates an example shelf 1100 of the refrigerator 100 of FIG. 1. The shelf 1100 may be positioned within the cooling compartment of the refrigerator 100. Various items may be placed on the shelf 1100. In this manner, the shelf 1100 allows items (e.g., cosmetic products) to be stored on the floor of the cooling compartment and on the shelf 1100. Some items may be long and may not fit in the cooling compartment when a conventional shelf is installed in the cooling compartment. As seen in FIG. 11, the shelf 1100 includes a cavity 1102 that is larger than other cavities that may be formed in the shelf 1100. In the example of FIG. 11, the cavity 1102 is positioned next to a corner of the shelf 1100. The cavity 1102 is triangular in shape, whereas other cavities defined by the shelf 1100 are cylindrical or rectangular in shape. Certain items may be stored in the cooling compartment such that the items rest on the floor of the cooling compartment and extend vertically upwards through the cavity 1102. As a result of the cavity 1102, the shelf 1100 does not prevent these items from being stored in the cooling compartment. FIG. 12 illustrates an example interior of the refrigerator 100 of FIG. 1. As seen in FIG. 12, the shelf 1100 is positioned within the cooling compartment 202 of the refrigerator 100. The cavity 1102 allows items to be stored in the cooling compartment 202 such that the items rest on the floor of the cooling compartment and extend upwards through the cavity 1102.

In summary, a cosmetic refrigerator 100 is equipped with an adjustable mirror 108 that may be moved to better assist the user put on cosmetic products. Generally, the mirror 108 is attached to a door 104 of the refrigerator by an arm 302 and hinges 308 and 310. The arm 302 and hinges 308 and 310 provide two axes of rotation for the mirror 108, which allows the mirror 108 to be moved and tilted to provide an adequate reflection of the user's face. A support arm 602 may also be attached to the mirror 108 and the arm 302 to support the weight of the mirror 108. In some instances, the mirror 108 may include lights 110 (e.g., light emitting diodes) that emit light towards the user to illuminate the user's face. In this manner, the cosmetic refrigerator 100 and mirror 108 provide more assistance to the user when putting on cosmetic products relative to conventional cosmetic refrigerators, in some embodiments.

In the current disclosure, reference is made to various embodiments. However, the scope of the present disclosure is not limited to specific described embodiments. Instead, any combination of the described features and elements, whether related to different embodiments or not, is contemplated to implement and practice contemplated embodiments. Additionally, when elements of the embodiments are described in the form of "at least one of A and B," or "at least one of A or B," it will be understood that embodiments including element A exclusively, including element B exclusively, and including element A and B are each contemplated. Furthermore, although some embodiments disclosed herein may achieve advantages over other possible solutions or over the prior art, whether or not a particular advantage is achieved by a given embodiment is not limiting of the scope of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

In view of the foregoing, the scope of the present disclosure is determined by the claims that follow.

I claim:

1. A refrigerator comprising:

a body;

a door movably coupled to the body, the door comprising an inner surface and an outer surface opposite the inner surface, the inner surface facing the body when the door is closed, the outer surface defining a trough, wherein the trough comprises a first portion and a second portion deeper than the first portion;

a first arm comprising a first end and a second end opposite the first end, the first arm movably coupled to the door by a first hinge positioned proximate the first end and within the first portion of trough;

a mirror movably coupled to the first arm by a second hinge positioned proximate the second end; and a second arm comprising a third end and a fourth end opposite the third end, the second arm movably coupled to the door by a third hinge positioned proximate the third end and within the second portion of trough, wherein the second arm is movably coupled to the first arm at the fourth end, wherein the first arm is arranged to rotate about the first hinge to move the mirror away from the door and to transition the first arm and the second arm from a first state to a second state, wherein the first arm is positioned within the first portion of the trough in the first state, wherein the second arm is positioned within the second portion of the trough in the first state, and wherein the mirror is arranged to rotate about the second hinge to tilt the mirror.

2. The refrigerator of claim 1, wherein the first arm and the second arm swing out of the trough in the second state.

3. The refrigerator of claim 2, wherein the first arm further comprises a first surface and a second surface opposite the first surface, and wherein the first surface faces the mirror and the second surface faces the trough when the first arm is in the first state.

4. The refrigerator of claim 2, further comprising a magnet coupled to the mirror such that the magnet pulls the mirror towards the door by a magnetic force when the first arm is in the first state.

5. The refrigerator of claim 1, further comprising:

a light coupled to the mirror;

a wire arranged to provide electrical power to the light, the wire extending through the first arm and the door; and a button arranged on the mirror, wherein the button is operable to turn on the light.

6. The refrigerator of claim 1, further comprising:

a first insulation disposed within the door and behind the trough; and a second insulation disposed within the door and different from the first insulation.

7. The refrigerator of claim 1, wherein the mirror houses a metal plate behind a reflective surface of the mirror.

8. The refrigerator of claim 1, wherein the door is coupled to the body by a fourth hinge such that the door is arranged to rotate about the fourth hinge in a direction that is orthogonal to a direction in which the first arm rotates about the first hinge.

9. The refrigerator of claim 1, wherein the second arm comprises an arm body and an extension positioned at the fourth end, wherein the extension is movably coupled to the arm body by a fourth hinge, and wherein the extension is movably coupled to the first arm.

10. A system comprising:

a door defining a trough comprising a first portion and a second portion deeper than the first portion;

a first arm comprising a first end and a second end opposite the first end, the first arm movably coupled to the door by a first hinge positioned proximate the first end and within the first portion of trough;

a mirror movably coupled to the first arm by a second hinge positioned proximate the second end; and a second arm comprising a third end and a fourth end opposite the third end, the second arm movably coupled to the door by a third hinge positioned proximate the third end and within the second portion of trough, wherein the second arm is movably coupled to the first arm at the fourth end, wherein the first arm is arranged to rotate about the first hinge to transition the first arm and the second arm from a first state to a second state, wherein the first arm is positioned within the first portion of the trough in the first state, and wherein the second arm is positioned within the second portion of the trough in the first state.

11. The system of claim 10, wherein the first arm and the second arm swing out of the trough in the second state.

12. The system of claim 11, wherein the first arm further comprises a first surface and a second surface opposite the first surface, and wherein the first surface faces the mirror and the second surface faces the trough when the first arm is in the first state.

13. The system of claim 11, further comprising a magnet coupled to the mirror such that the magnet pulls the mirror towards the door by a magnetic force when the first arm is in the first state.

14. The system of claim 10, further comprising:

a light coupled to the mirror;

a wire arranged to provide electrical power to the light, the wire extending through the first arm and the door; and a button arranged on the mirror, wherein the button is operable to turn on the light.

15. The system of claim 10, further comprising:

a first insulation disposed within the door and behind the trough; and a second insulation disposed within the door and different from the first insulation.

16. The system of claim 10, wherein the second arm comprises an arm body and an extension positioned at the fourth end, wherein the extension is movably coupled to the arm body by a fourth hinge, and wherein the extension is movably coupled to the first arm.

17. A system comprising:

a door defining a trough comprising a first portion and a second portion deeper than the first portion;

a first arm comprising a first end and a second end opposite the first end, the first arm movably coupled to the door by a first hinge positioned proximate the first end and within the first portion of the trough;

a mirror movably coupled to the first arm by a second hinge positioned proximate the second end; and a second arm comprising a third end and a fourth end opposite the third end, the second arm movably coupled to the door by a third hinge positioned proximate the third end and within the second portion of the trough, wherein the second arm is movably coupled to the first arm at the fourth end, wherein the first arm is arranged to rotate about the first hinge to move the mirror away from the door and to transition the first arm and the second arm from a first state to a second state, wherein the first arm is positioned within the first portion of the trough in the first state, wherein the second arm is positioned within the second portion of the trough in the first state, and wherein the mirror is arranged to rotate about the second hinge to tilt the mirror.

18. The system of claim 17, wherein the first arm and the second arm swing out of the trough in the second state.

* * * * *